US007441349B2

(12) United States Patent
Seydel et al.

(10) Patent No.: US 7,441,349 B2
(45) **Date of Patent: *Oct. 28, 2008**

(54) SHOE WITH OPTIMAL MASS DISTRIBUTION

(75) Inventors: Roland G. Seydel, Herzogenaurach (DE); Wolfgang Scholz, Lonnerstadt (DE)

(73) Assignee: adidas International Marketing B.V., Amsterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 11/541,825

(22) Filed: Oct. 2, 2006

(65) Prior Publication Data

US 2007/0022633 A1 Feb. 1, 2007

Related U.S. Application Data

(63) Continuation of application No. 10/795,957, filed on Mar. 8, 2004, now Pat. No. 7,181,869.

(30) Foreign Application Priority Data

Mar. 11, 2003 (DE) ..... 103 10 526

(51) Int. Cl.
*A43B 5/00* (2006.01)

(52) U.S. Cl. ..... 36/114; 36/132; 36/43; 482/105; 482/79

(58) Field of Classification Search ..... 36/114, 36/132, 43, 44, 76 C, 108; 482/79, 105, 482/14, 51, 74, 80
See application file for complete search history.

(56) References Cited

U.S. PATENT DOCUMENTS 2,070,269 A * 2/1937 Goldenberg ..... 36/134
2,545,910 A 3/1951 George
3,333,352 A 8/1967 Winstons
3,517,928 A 6/1970 Shanahan
3,785,646 A 1/1974 Ruskin
4,252,315 A 2/1981 Kimura
4,458,432 A 7/1984 Stempski
4,709,921 A 12/1987 Valuikas et al.
4,729,179 A * 3/1988 Quist, Jr. ..... 36/44
4,777,743 A 10/1988 Roehrig, Jr.
4,784,143 A 11/1988 Hebert et al.
5,070,629 A 12/1991 Graham et al.
5,082,284 A 1/1992 Reed
5,231,776 A 8/1993 Wagner
5,638,613 A 6/1997 Williams
5,728,032 A 3/1998 Glass
5,758,435 A 6/1998 Miyata
5,893,223 A 4/1999 Glass
5,901,473 A 5/1999 Heifort, IV (Continued)

FOREIGN PATENT DOCUMENTS

FR 2572257 * 10/1984

(Continued)

*Primary Examiner*—Marie Patterson
(74) *Attorney, Agent, or Firm*—Goodwin Procter LLP

(57) ABSTRACT

Disclosed is a shoe including an upper for receiving a foot and a sole unit with a heel region and forefoot region, wherein an additional weight is arranged in at least one of the forefoot region and the heel region of the sole unit to stabilize the foot against at least one torque acting on a wearer's foot.

14 Claims, 6 Drawing Sheets

U.S. PATENT DOCUMENTS

| | | | | |
|---|---|---|---|---|
| 6,270,422 | B1 | 8/2001 | Fisher | |
| 6,341,434 | B1 * | 1/2002 | Yeh | 36/132 |
| 6,397,498 | B1 | 6/2002 | Yoo | |
| 6,431,995 | B1 | 8/2002 | Jackson | |
| 6,543,160 | B2 | 4/2003 | Price | |
| 6,565,462 | B1 | 5/2003 | Gregg | |
| 6,585,604 | B1 | 7/2003 | Morrone | |
| 6,641,490 | B2 | 11/2003 | Ellemor | |
| 6,695,937 | B1 | 2/2004 | Stites, III | |
| 6,710,237 | B2 | 3/2004 | Adams | |
| 6,715,219 | B2 | 4/2004 | Bock | |
| 6,729,983 | B1 | 5/2004 | Vakili et al. | |
| 6,742,288 | B2 | 6/2004 | Choi | |
| 2001/0000835 | A1 | 5/2001 | Hines | |
| 2002/0017039 | A1 | 2/2002 | Hines | |
| 2003/0097771 | A1 | 5/2003 | Tuttle | |

FOREIGN PATENT DOCUMENTS

| | | |
|---|---|---|
| FR | 2572257 | 5/1986 |

* cited by examiner

SHOE WITH OPTIMAL MASS DISTRIBUTION

CROSS REFERENCE TO RELATED APPLICATION

This application incorporates by reference, and claims priority to and the benefit of German patent application serial number 10310526.3, filed on Mar. 11, 2003.

TECHNICAL FIELD

The present invention relates to a shoe with additional weight added thereto to modify a performance characteristic thereof.

BACKGROUND

Shoes, in particular soccer shoes, have two functions: first, to increase the grip of the shoe on a playing surface, e.g., a field, by providing profile elements, such as studs; and second, to improve the control of the ball by a player and the delivery of sharp shots to the ball, by virtue of the design of the upper of the shoe. For example, it is known to provide the surface of the instep of a soccer shoe with friction enhancing elements in order to improve control of the ball by the player.

A further design objective for a soccer shoe, similar to a running shoe, is to make the shoe as lightweight as possible. A reduction in the weight of the shoe reduces the power of the player necessary for the course of movements, since the forces of inertia to be surmounted increase proportionally to the mass of the shoe. A lightweight shoe needs less power for being moved than a heavy shoe. This applies for both running and kicking a ball. The increasing use of lightweight, but highly stable plastic materials, facilitates the manufacturing of shoes with an overall weight of less than 300 grams (g).

For training purposes, however, it is known to provide additional weights in the shoes for selectively strengthening the muscles of the leg and the foot. Examples of this concept can be found in published U.S. Patent Application Nos. 2001/0000835 A1 and 2002/0017039 A1, as well as in issued U.S. Pat. No. 5,758,435, the entire disclosures of which are hereby incorporated by reference herein. For example, each application/patent discloses training weights arranged in a wide variety of sole areas of the shoes. With respect to soccer shoes, it is specifically known from issued U.S. Pat. No. 5,901,473, the disclosure of which is hereby incorporated herein by reference in its entirety, to increase the weight of the shoe during training by using particularly heavy studs on the shoe. Thus, the player can develop an additional power reserve without having to use a different shoe. For a game, however, the heavy training studs are replaced by common lightweight studs in order to obtain the above-described advantages of a particularly lightweight shoe.

A shoe provided with additional weights may in the long term increase the overall performance of an athlete; however, a direct improvement of the shooting power of a player or the player's feel for the ball is not obtained by this approach. There is, therefore, a need for a soccer shoe that allows a player to shoot the ball in a sharper and more controlled manner than with conventional soccer shoes.

SUMMARY OF THE INVENTION

The present invention generally relates to a shoe incorporating additional weight in its sole to stabilize a foot against at least one torque acting on the foot, for example, when shooting a ball.

In contrast to the evenly distributed training weights of the prior art and in accordance with one embodiment of the invention, an additional weight is selectively arranged in, for example, the forefoot region of a sole unit of the shoe for increasing the shooting performance. Thus, an additional moment of inertia of the soccer shoe is created with respect to a rotation of the foot to the lateral or medial side. This moment of inertia acts against the torque caused by the ball contact on the medial or lateral side and, thereby, stabilizes the course of movements. The effort to maintain the foot in the desired position for a sharp shot is reduced. This allows a player to shoot the ball more sharply, which increases the performance of the player.

Further, the stabilization achieved by the additional weight improves the control of the ball, since a foot having a greater moment of inertia can be more exactly guided during ball contact. A mis-hit of a shot, which is caused by a deviation of the foot from the intended orientation and course of movement during ball contact due to the torque applied by the ball, becomes less likely.

In one aspect, the invention relates to an article of footwear including an upper for receiving a foot, a sole unit coupled to the upper and having a heel region and a forefoot region, and a weight arranged in the sole unit for stabilizing the foot against at least one torque acting on the foot when striking an object. In one embodiment, the weight is arranged in at least one of the forefoot region and the heel region. In a particular embodiment, the weight can be arranged in an area corresponding to at least one of a metatarsal area and a phalanges area of the foot. In various embodiments, the weight can be relatively light, for example, in one embodiment the weight may be from about 10% to about 40% of the overall weight of the shoe. In another example, such as dry playing conditions, the weight may be from about 15% to about 45% of the overall weight of the shoe. In yet another example, such as wet playing conditions, the weight may be from about 10% to about 20% of the overall weight of the shoe.

In various embodiments, the additional weight, as viewed from above, is substantially symmetrically distributed around at least one of an axis running generally through an area corresponding to first and second metatarso-phalangeal joints and an axis running generally through an area corresponding to third, fourth, and fifth metatarso-phalangeal joints of the foot. This arrangement leads, with a minimal overall weight of the shoe, to the greatest moment of inertia and, thereby, to the greatest stabilization effect. This applies in particular, because ball contacts are usually made with the aforementioned areas of the foot.

In additional embodiments, the additional weight is a mass greater than or equal to about 30 g, preferably greater than or equal to about 40 g, and more preferably from about 45 g to about 90 g. The addition of even such small weights leads to measurable improvements of the shooting performance of a player. The increase in the overall weight of the shoe is insignificant, in particular, if the additional weight is compensated for by a particular lightweight construction of the remaining shoe.

The additional weight can include a composite material, for example, a plastic material and a metal. The composite material can include, for example, aluminum, iron, lead, tungsten, polymers, and combinations thereof. In one embodiment, the composite material includes tungsten embedded into a polymer matrix. The high density of tungsten provides the desired mass values for the additional weight with comparatively small elements, which can, therefore, be very selectively arranged in the sole unit.

Further, the additional weight may be integrated into the sole unit as at least one ballast element. In this alternative arrangement, the moment of inertia provided by the additional weight is fixed. In various embodiments, the additional weight is releasably attached to the sole unit and/or the additional weight is integrated into a removable inlay. Additionally or alternatively, the additional weight can be releasably coupled to a receptacle of the sole unit, for example, the additional weight can be integrated into at least one profile element coupled to the article of footwear. In another example, the additional weight is provided as at least one washer disposed between the at least one profile element and the article of footwear. The additional weight can be arranged on a medial side, a lateral side, or both sides of the sole unit. A releasable attachment allows the player to remove, either partly or completely, the additional weight from the shoe or to modify the exact position of the additional weight in the sole unit. This provides the possibility for an individual adaptation of the dynamic properties of the soccer shoe during ball contact.

These and other objects, along with the advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the present invention are described with reference to the following drawings, in which.

DETAILED DESCRIPTION

Embodiments of the present invention are described below. It is, however, expressly noted that the present invention is not limited to these embodiments, but rather the intention is that modifications that are apparent to the person skilled in the art are also included. The terms "soccer shoe" or "shoe" are intended to designate in the following description every sports shoe that serves to move, for example, a ball or the like by the foot. Accordingly, the invention can also be used for sports where the ball is additionally played with the hands.

Figure 1:
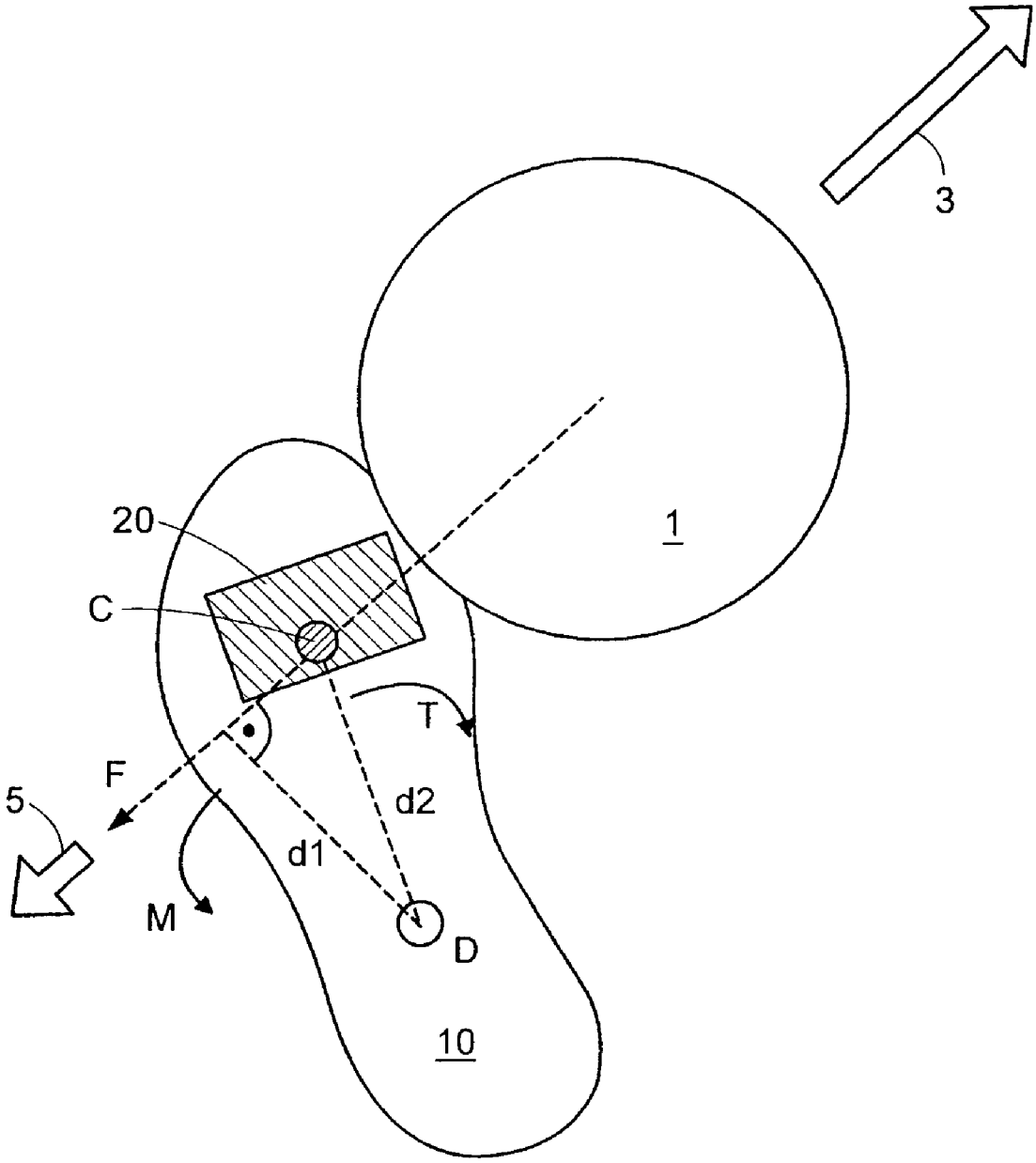
FIG. 1 is a schematic representation of a stabilization effect caused by a moment of inertia due to a weight disposed in a shoe in accordance with one embodiment of the invention.

FIG. 1 depicts schematically the physical vector quantities acting between a shoe 10 and a ball 1. In the case of a shot in the direction of the large arrow 3, a force "F" is acting on the shoe 10 in accordance with Newton's law of action and reaction. The force F creates a torque "M", the amount of which is determined by the product of the force F and the distance "$d_1$" to the rotational axis "D" of the foot (approximately positioned at the end of the lower leg). In the case of a kick with an inner side of the instep, as shown in FIG. 1, the torque M has a counterclockwise direction, whereas in the case of a kick with the outer side of the instep, the torque acts in a clockwise direction on the shoe 10.

In conventional soccer shoes, the total torque M has to be sustained by the muscles of the foot of the player. Because, however, the foot cannot be maintained completely rigid even under high tensioning of the muscles, the foot will slightly yield during ball contact in the direction of the torque M (small arrow 5). This yielding reduces the transfer of linear momentum onto the ball 1 and, thereby, the resulting shooting performance of the player.

In one aspect, the invention is based on the recognition that the acting torque M can be reduced, if the shoe 10 exhibits an increased moment of inertia "T" with respect to the aforementioned rotation. The increased moment of inertia T is determined by the mass of the additional weight 20 in the forefoot region and the square of the distance "$d_2$" between the axis of rotation D and the centroid "c" of the additional weight 20. An additional weight in the forefoot region within the meaning of the present invention is any weight that is not caused by any other functional requirements of the shoe 10, such as, for example, the shape of the profile, the stability of the upper, or the shape of an inlay. Additionally or alternatively, the additional weight 20 can be located in a heel region of the shoe 10.

In a similar manner as the inertia of a mass of a body resists a linear acceleration, the additional moment of inertia T caused by the additional weight 20 of the shoe 10 resists the torque M arising during ball contact. The requirements on the muscles of the player to shoot the ball with a high velocity are correspondingly reduced, so that higher ball velocities can be achieved.

Computer simulations at the University of Calgary have shown that an additional weight in the forefoot region having a mass greater than or equal to about 30 g leads, in soccer shoes having an overall weight from about 250 g to about 350 g, to an increase of the resulting ball velocities of a few percent. With higher masses, for example between about 45 g and about 90 g, even higher values were obtained. This was confirmed by statements of athletes who tested soccer shoes with additional weights of varying masses. An additional weight having a mass in the range of about 60 g to about 90 g was found to be desirable for dry conditions, while a mass of about 45 g was found to be desirable for wet playing conditions.

Additional weights of greater masses are advantageous for increasing shooting performance; however, the effort for running increases depending on the overall weight of the shoe 10, which increases with the additional weight. The indicated values, therefore, present one possible compromise between the two opposing requirements of an increased moment of inertia and a low overall weight. In one application, this compromise is based on the length of time of a typical soccer game being two halves of 45 minutes each. For other situations, for example, if the time length of the game is shorter or if there are more frequent pauses, other values may be reasonable for the mass of the additional weight. In addition, other possible mass values may be reasonable either for a different sport or if the overall weight of the shoe 10 is reduced by the use of new or alternative materials or other technical advantages.

In addition to increasing shooting performance, the additional weight in the forefoot region improves the player's ability to control the ball. If the yielding movement of the shoe 10 (as indicated in FIG. 1 by arrow 5) is reduced by means of the additional moment of inertia T, the ball can be more precisely guided and the probability of a mis-hit of a shot is reduced.

Figure 2:
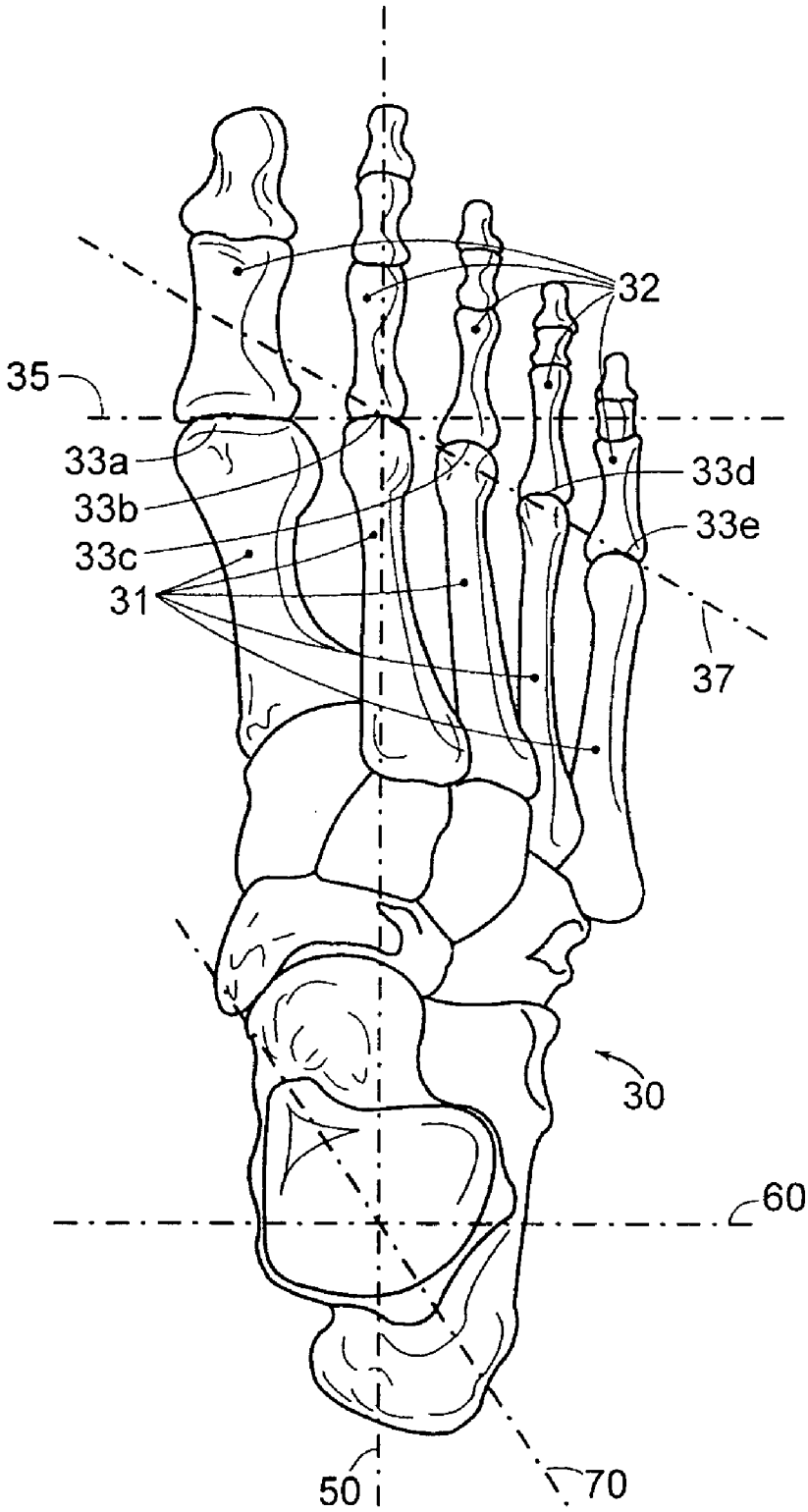
FIG. 2 is a schematic top view of a skeleton of a human foot.

Further, the aforementioned tests have shown that arranging the additional weight in the regions of the shoe 10 corresponding to the player's metatarsals 31 and phalanges 32, which can be seen in the top view of a skeleton of a human foot 30 presented in FIG. 2, is desirable. Further, FIG. 2 shows the position of an axis 35 that generally runs through the first and second metatarso-phalangeal joints 33*a*, 33*b* (i.e., through the joints of the two medial metatarsals 31 and phalanges 32) and the position of an axis 37 that generally runs through the third, fourth and fifth metatarso-phalangeal joints 33*c*, 33*d*, 33*e* (i.e., through the three lateral joints between the metatarsals 31 and the phalanges 32).

In addition to the metatarso-phalangeal axes 35, 37, FIG. 2 also depicts the position of a longitudinal axis 50 of the foot, as well as a talocrural axis 60 and a subtalar axis 70. The above discussion of the physical vector quantities is simplified, since in addition to the torque M around the axis of rotation D, other torques around other axes of the foot will become effective during a shot. For example, it can be seen that in the case of an upwardly directly shot, there will be a substantial torque around the talocrural axis 60; however, since the additional weight 20 can be positioned in the forefoot region of the shoe 10, i.e. the part of the shoe 10 which contacts the ball, the effects of all of these torques are reduced by the additional weight 20, which provides an additional moment of inertia for a rotation about any of the aforementioned axes.

Figure 3A:
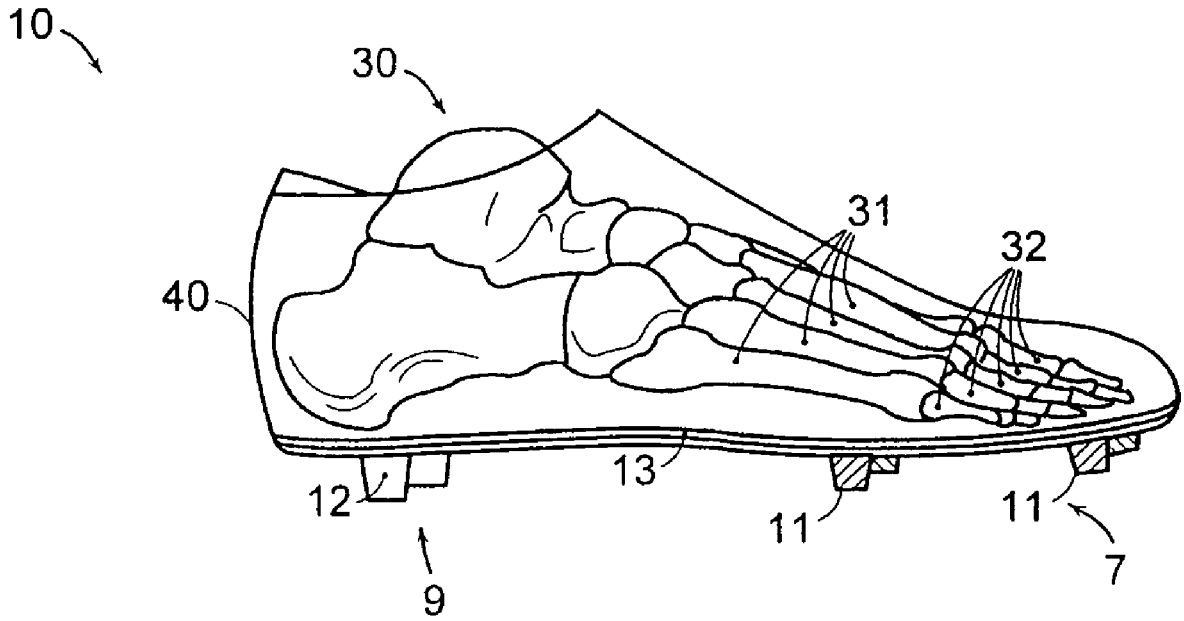
FIG. 3A is a schematic side view of one arrangement of additional weight in a shoe in accordance with one embodiment of the invention, using particularly heavy studs in the forefoot region.

FIG. 3A depicts one embodiment of the shoe 10 of FIG. 1, in accordance with the invention, where studs 11 are arranged in the forefoot region 7 that are heavier than the other studs 12 of the shoe 10. For example, the front studs 11 may be made from a suitable high density metal, whereas lightweight plastic materials are used for the rear studs 12. The use of composite materials for the heavy studs 11, for example tungsten or lead embedded into a matrix of plastic material, is also possible.

The shoe 10 also includes an upper 40 for receiving the foot 30 and a sole unit 13 coupled thereto. The upper 40 can be any conventionally known type of upper or may be modified to include pockets or other structures for receiving additional weight. The sole unit 13 generally includes an insole, a midsole, and an outsole and can be modified as necessary to receive the additional weight. The actual construction of and types of materials used for the sole unit 13 will vary to suit a particular application.

Figure 3B:
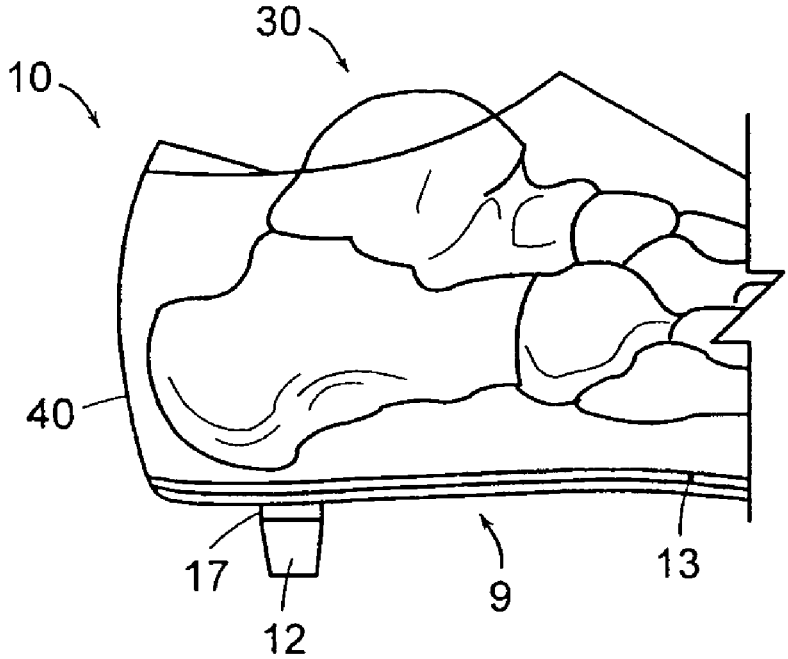
FIG. 3B is an enlarged schematic side view of a heel region of the shoe of FIG. 3A, depicting an alternative arrangement of the additional weight.

As can be seen in FIG. 3A, the heavy studs 11 in the forefoot region 7 are arranged below the metatarsals 31 and phalanges 32 of the foot 30. The exact arrangement and the number of lightweight studs 12 and heavy studs 11 used will vary to suit a particular application. If the studs 11 are releasably mounted to the sole unit 13 of the shoe 10, the mass of the additional weight can be individually adjusted to the needs of a player. For example, heavy washers 17 or the like can be arranged between the studs 11 and the sole unit 13 to provide an additional weight. The heavy washers 17 could be exchanged with lightweight washers, for example made from a suitable plastic material, when the additional weight is not needed or if an adjustment is necessary. As shown in FIG. 3B, the heavy washers 17 can be used with the lightweight studs 12 to add weight to the heel region 9 of the shoe 10.

Figure 4A:
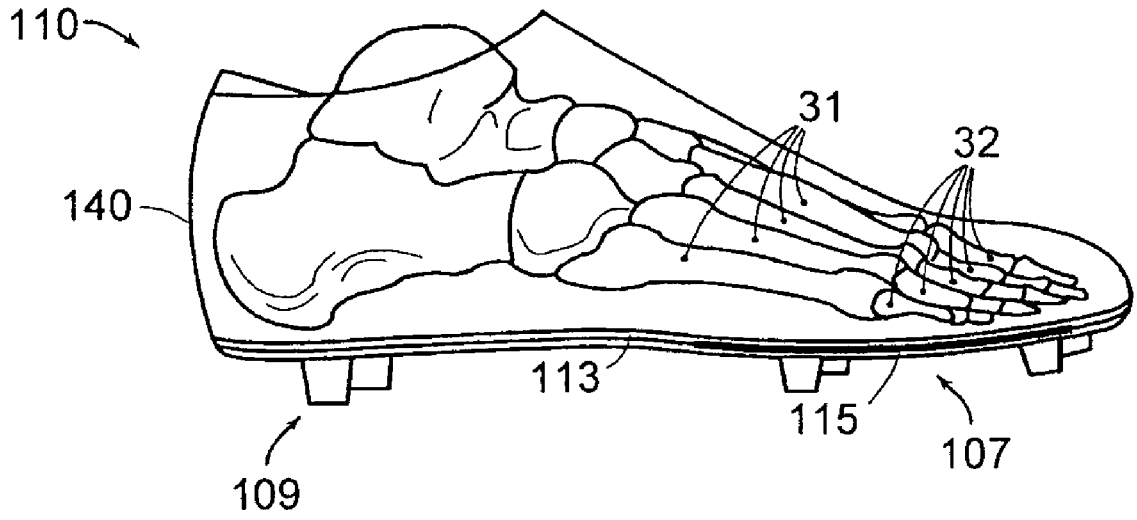
FIGS. 4A and 4B are schematic side views of alternative embodiments of a shoe in accordance with the invention, where the additional weight is a plate integrated into sole layers of the shoe.
Figure 4B:
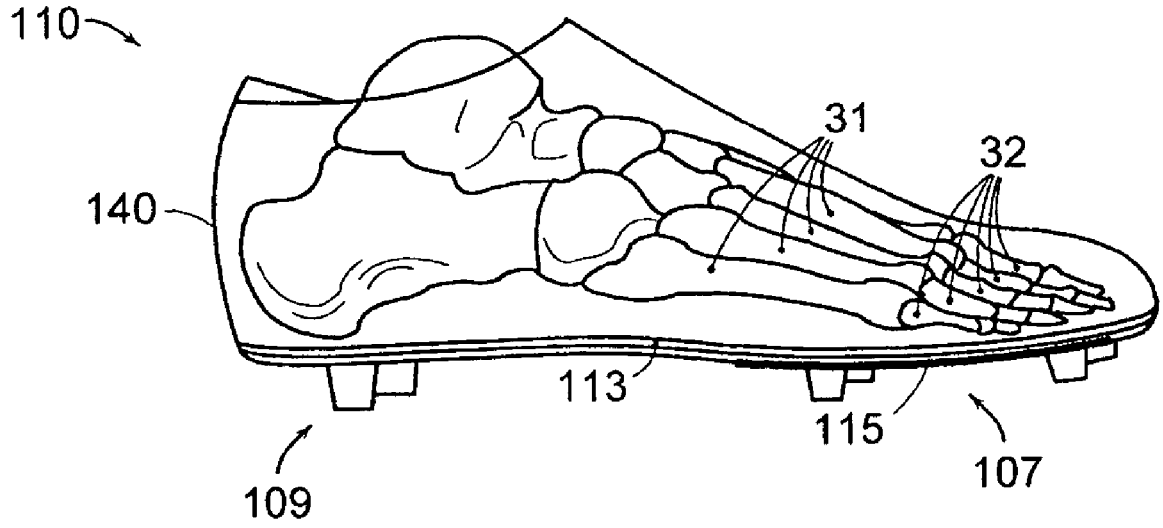
Figure 4F:
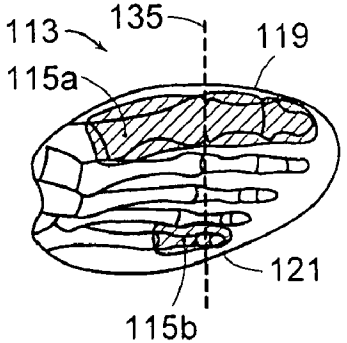
FIGS. 4C-4F are schematic bottom views of alternative embodiments of a shoe in accordance with the invention, where the additional weight is a plate integrated into sole layers of the shoe.

FIGS. 4A-4F depict alternative embodiments of a soccer shoe 110 in accordance with the invention, wherein the additional weight is integrated as a plate 115 into the forefoot region 107 of the sole unit 113. Alternatively or additionally, a weight can be arranged in the heel region 109 of the sole unit 113 by any of the methods disclosed herein. A releasable embodiment may be provided by using the plate 115 as an inlay, which may be removed or replaced by an inlay of a different mass. In FIG. 4A the plate 15 is embedded into an intermediate sole layer, for example the midsole. In FIG. 4B the plate 15 is arranged in or below the outsole.

The plate 115 can be embedded, attached, or otherwise integrated into the sole unit 113 in a variety of ways. For example, the insole and/or midsole can be manufactured with a recess for receiving the plate 115. The plate 115 can be secured in the recess by bonding, for example, using a liquid epoxy, a hot melt adhesive, or a solvent. Alternatively, the plate 115 can be secured by a slight friction fit, which would allow the wearer to remove and replace the plate 115 with a plate having a different mass. In another embodiment, the plate 115 can be positioned in a mold and the sole unit 113 can be injection molded around the plate 115. Further, the plate 115 can be bonded or otherwise mechanically attatched to the sole unit 113. For example, the plate 115 could be bonded to the outsole.

The FIGS. 4C-4F depict alternative arrangements of the plate 115 in the sole unit 113. The plate 115 is shown located in the forefoot region 107 of the sole unit 113; however, the plate 115 could alternatively or additionally be located in the heel region 109 of the sole unit 113. The particular application of the shoe 110 will determine the mass and position of the weight to be added.

Figure 4E:
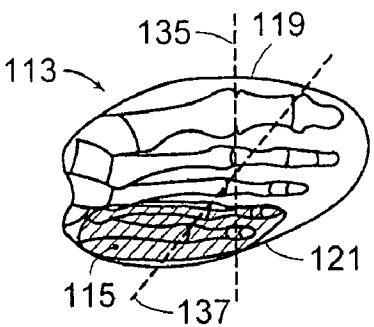
Figure 4D:
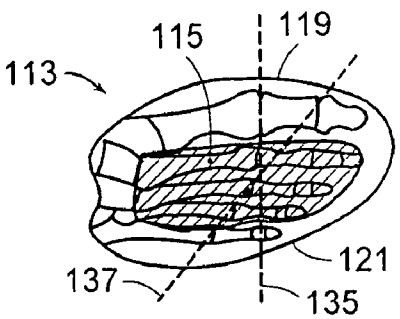
Figure 4C:
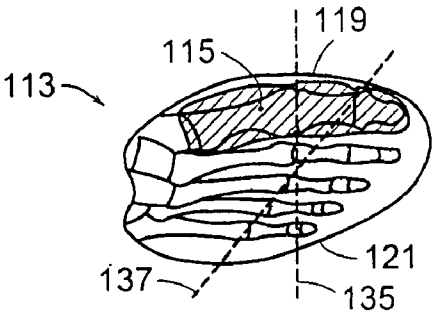

FIG. 4C depicts the additional weight (plate 115) arranged substantially on a medial side 119 of the sole unit 113. The plate 115 is depicted as having a generally oblong shape; however, the plate 115 can have essentially any shape, such as polygonal, arcuate, or combinations thereof. FIG. 4D depicts a substantially centralized arrangement, where the plate 115 is located generally symmetrically about the intersection of the metatarso-phalangeal axes 135, 137. The shape, size, and position of the plate 115 will vary to suit a particular application. FIG. 4E depicts the plate 115 arranged on a lateral side 121 of the sole unit 113. In the embodiment depicted in FIG. 4F, the additional weight includes two plates 115*a*, 115*b*. The first, larger plate 115*a* is arranged on the medial side 119 of the sole unit 113, and the second, smaller plate 115*b* is arranged on the lateral side 121 of the sole unit 113. In addition to these exemplary arrangements, it is possible to arrange one or more additional weights adjacent to the metatarsals 131 and/or the phalanges 132.

As can be seen in FIGS. 4C-4F, the plate 15 is substantially symmetrically distributed in the sole unit 113 with respect to one or both of the metatarso-phalangeal axes 135, 137. The center of gravity of the additional weight, the position of which determines the above discussed moment of inertia T, is therefore approximately in the transition region between the metatarsals 131 and the phalanges 132. This corresponds to one of the most favorable positions of the center of gravity found during testing, for improving the performance of the shoe 10, 110 during certain applications.

Figure 5A:
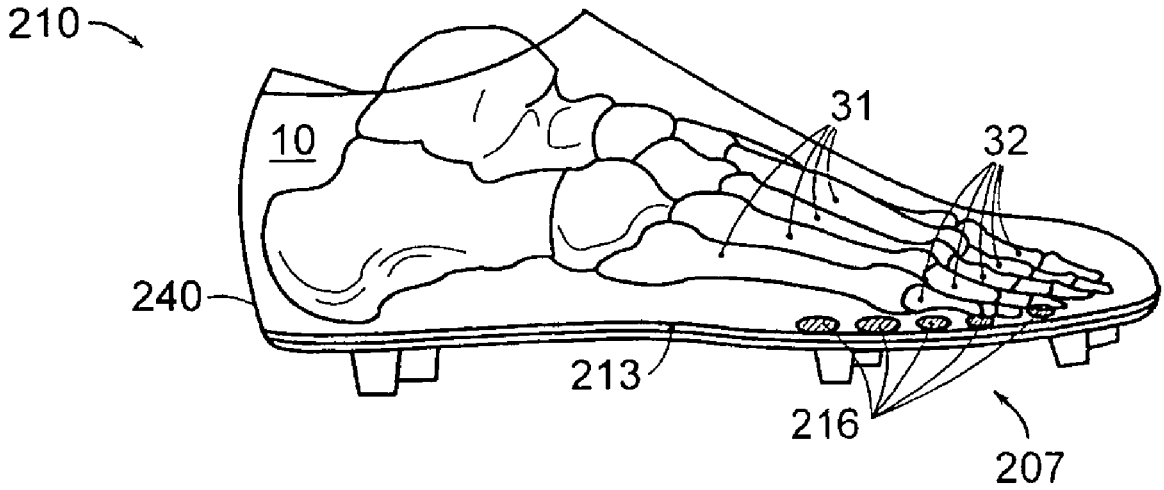
FIG. 5A is a schematic side view of an alternative embodiment of a shoe in accordance with the invention, where the additional weight is a plurality of separate ballast elements integrated into sole layers of the shoe.
Figure 5B:
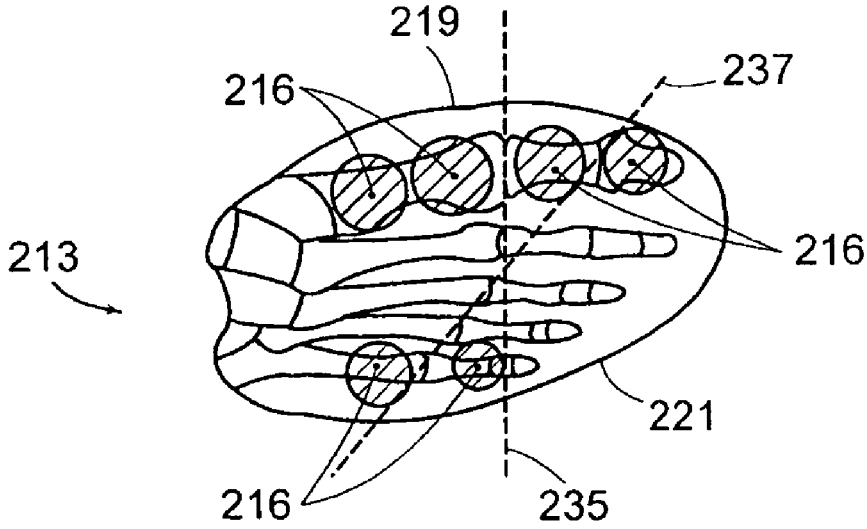
FIG. 5B is a schematic bottom view of the shoe of FIG. 5A.

FIGS. 5A and 5B depict an alternative embodiment of a shoe 210 in accordance with the invention. Instead of a plate 115, the additional weight is made up of a plurality of ballast elements 216 integrated into, for example, a forefoot region 207 of the sole unit 213. The ballast elements 216 can be integrated into the various layers of the sole unit 213, as discussed above with respect to FIGS. 4A-4E. Additionally, individual ballast elements 216 can be screwed in or releasably attached in other ways to the sole unit 213. To avoid the penetration of dirt into the corresponding threads or other attachment devices when a ballast element 216 is removed, it is possible to use dummy screws or other corresponding covering elements. The dummy screws or covering elements can be made of a lightweight material, for example, a plastic material.

FIG. 5B depicts an exemplary distribution of the ballast elements 216 on a medial side 219 and a lateral side 221 of the forefoot region 207 of the sole unit 213. Also in this embodiment, the distribution is substantially symmetrical, with respect to the metatarso-phalangeal axes 235, 237. The size and shape of the individual ballast elements can vary to suit a particular application. The use of individual ballast elements 216 is advantageous compared to the use of a plate 115, if the flexibility of the sole unit 213, in particular in the longitudinal direction of the shoe 210, is not to be impaired by the additional weight.

Generally, composite materials are used for the additional weight, for example a metal embedded into a polymer matrix of a plastic material. The variation of the metal fraction allows easy adjustment of the mass of the additional weight. If flexible plastic materials or gels are used as matrix materials, the bending properties of the sole unit 13, 113, 213 remain substantially unaffected by the arrangement of the additional weight. In a particular embodiment, the composite material includes tungsten, which, due to its high density, allows a selective positioning of concentrated masses in the desired regions of the sole unit 13, 113, 213. Furthermore, the physical and chemical properties of tungsten are well-suited for insertion into a sole unit; however, other metals or alloys such as lead or steel can also be used. Examples of suitable polymeric materials include: polyurethanes, such as a thermoplastic polyurethane (TPU); thermoplastic polyether block amides, such as the Pebax® brand sold by Elf Atochem; thermoplastic polyester elastomers, such as the Hytrel® brand sold by DuPont; nylons; silicones; polyethylenes; and equivalent materials.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

The invention claimed is:

1. An article of footwear, comprising:
an upper for receiving a foot;
a sole unit comprising an outsole and an insole removably disposed within the article of footwear, the sole unit coupled to the upper and further comprising:
a heel region;
a forefoot region;
a medial side;
a lateral side; and
a longitudinal axis; and
a generally oblong weight substantially centrally disposed between the medial side and the lateral side of the sole unit and oriented substantially parallel to the longitudinal axis of the sole unit, the weight arranged substantially solely in the forefoot region of the sole unit for stabilizing the foot against at least one torque acting on the foot when striking an object, wherein the weight is integrated into the removable insole.

2. The article of footwear of claim 1, wherein the weight extends from proximate an area corresponding to a base of a wearer's metatarsals to proximate an area corresponding to the wearer's toes.

3. The article of footwear of claim 1, wherein the weight comprises from about 10% to about 40% of an overall weight of the article of footwear.

4. The article of footwear of claim 1, wherein the weight comprises a mass greater than about 30 g.

5. The article of footwear of claim 1, wherein the weight comprises a mass between about 45 g and about 90 g.

6. The article of footwear of claim 1, wherein the weight comprises a composite material, the composite material comprising a plastic material and a metal.

7. The article of footwear of claim 1, wherein the weight is releasably attached to the removable insole.

8. An article of footwear, comprising:
an upper for receiving a foot;
a sole unit coupled to the upper and comprising:
an outsole;
a midsole; and
an insole including a lower side; and
a weight attached to the lower side of the insole, wherein the insole and weight are removably disposed within the article of footwear and the midsole comprises an upper surface defining a recess configured for receiving the weight attached to the lower side of the insole, the weight arranged in the sole unit for stabilizing the foot against at least one torque acting on the foot when striking an object.

9. The article of footwear of claim 8, wherein the weight is attached substantially solely to a forefoot region of the insole.

10. The article of footwear of claim 8, wherein the weight is releasably attached to the insole and is interchangeable with a weight having a different mass.

11. The article of footwear of claim 8, wherein the weight comprises a generally oblong shape.

12. The article of footwear of claim 11, wherein the insole comprises:
a heel region;
a forefoot region;
a medial side;
a lateral side; and
a longitudinal axis, wherein the weight is substantially centrally disposed between the medial side and the lateral side of the insole and oriented substantially parallel to the longitudinal axis of the insole.

13. An inlay for an article of footwear, the inlay comprising:
an insole configured to be removably disposed within the article of footwear, the insole comprising:
a heel region;
a forefoot region;
a medial side; and
a lateral side; and
a weight coupled to the insole, wherein the weight comprises a generally oblong shape substantially centrally disposed between the medial side and the lateral side of the insole and oriented substantially parallel to a longitudinal axis of the insole, the weight arranged substantially solely in the forefoot region of the insole for stabilizing a foot against at least one torque acting on the foot when striking an object.

14. The inlay of claim 13, wherein the insole is injection molded about the weight.

* * * * *